US005307128A

United States Patent [19]

Murasaki et al.

[11] Patent Number: 5,307,128

[45] Date of Patent: Apr. 26, 1994

[54] TONER SUPPLYING DEVICE

[75] Inventors: Hiroshi Murasaki, Ibaragi; Masanori Fujiwara, Izumiotsu, both of Japan

[73] Assignee: Minolta Camera Kabushiki Kaisha, Osaka, Japan

[21] Appl. No.: 750,533

[22] Filed: Aug. 27, 1991

[30] Foreign Application Priority Data

Aug. 28, 1990 [JP] Japan ..... 2-227245

[51] Int. Cl.[5] ..... G03G 15/06

[52] U.S. Cl. ..... 355/260; 355/246; 355/298

[58] Field of Search ..... 355/298, 245, 246, 280, 355/260, 208; 222/DIG. 1; 118/653

[56] References Cited

U.S. PATENT DOCUMENTS

| | | | |
|---|---|---|---|
| 3,678,896 | 7/1972 | Hewitt | 355/298 X |
| 3,752,576 | 8/1973 | Gerbasi | 355/298 X |
| 3,983,841 | 10/1976 | Norton | 355/298 X |
| 4,032,227 | 6/1977 | Hubbard et al. | 355/245 |
| 4,639,117 | 1/1987 | Murai et al. | 355/246 |
| 4,696,565 | 9/1987 | Imanka | 355/298 |
| 4,768,055 | 8/1988 | Takamatsu et al. | 355/298 |
| 4,883,019 | 11/1989 | Menjo et al. | 355/246 X |
| 4,894,688 | 1/1990 | Taniguchi et al. | 355/298 |
| 4,899,690 | 2/1990 | Hacknauer et al. | 355/260 X |
| 4,941,022 | 7/1990 | Ohmura et al. | 355/260 X |
| 5,017,962 | 5/1991 | Tsuji et al. | 355/245 X |
| 5,075,186 | 12/1991 | Sheridon | 355/280 X |
| 5,079,593 | 1/1990 | Satoh et al. | 355/298 |
| 5,128,724 | 7/1992 | Hayashi et al. | 355/298 |
| 5,231,458 | 7/1993 | Nishimura | 355/298 |

FOREIGN PATENT DOCUMENTS

| | | |
|---|---|---|
| 55-73078 | 6/1980 | Japan . |
| 55-103578 | 8/1980 | Japan . |
| 56-66884 | 6/1981 | Japan . |
| 63-45113 | 9/1988 | Japan . |

*Primary Examiner*—A. T. Grimley
*Assistant Examiner*—Shuk Y. Lee
*Attorney, Agent, or Firm*—Willian Brinks Hofer Gilson & Lione

[57] ABSTRACT

A toner supplying device for supplying toner to a developing device in an electrophotographic image forming apparatus comprises a toner hopper for containing and feeding new toner, a recycle device for introducing toner from a cleaner which collects residual toner on an electrostatic latent image carrying member to an outlet of the hopper or the vicinity thereof, a toner agitating chamber opposed to the outlet of the hopper and an outlet of the recycle device, a toner agitating member disposed in the toner agitating chamber, and a toner feeder for feeding the toner from the toner agitating chamber to the developing device.

28 Claims, 4 Drawing Sheets

TONER SUPPLYING DEVICE

BACKGROUND OF THE INVENTION

1. Field of the Invention

The present invention relates an image forming apparatus such as an electrophotographic copying machine and an electrophotographic printer, and particularly to a toner supplying device used therein for supplying toner to a developing device which develops an electrostatic latent image on an electrostatic latent image carrying member.

2. Description of the Related Arts

Such toner supplying devices have been known that can merely supply new toner to a developing device and that can supply not only the new toner but also collected toner which is collected by a cleaner from an electrostatic latent image carrying member by recycle means.

The means for recycling the toner, which is collected by the cleaner, to the developing device is disclosed in the Japanese Examined Patent Publication No. 63-45113, and the Japanese Laid-Open Patent Publication Nos. 55-73078, 55-103578 and 56-66884.

According to summarized contents of these publications, resupplying of the collected toner is performed by (a) supplying the collected toner without processing, (b) supplying the collected toner without processing when new toner is not supplied, and supplying the collected toner together with the new toner when the new toner is supplied in response to a new toner feed instruction signal sent from appropriate means such a toner density sensor or an image density sensor, or (c) supplying the collected toner after applying to it corona charging of the same polarity as the toner polarity at a developing section when it is located on an electrostatic latent image carrying member (Japanese Examined Patent Publication No. 63-45113).

However, the toner generally includes various kinds of additives or particles stuck thereto. Such additives and particles may include a fluidization agent such as silica, aluminium oxide, titanium oxide or magnesium fluoride; chargeable particles of silica, titanium oxide or the like to which coupling processing has been applied by chargeable monomer (e.g., monomer having amino group or fluorine atom); resin beads serving as a cleaning assistant, an abrasive for removing a deteriorated layer on a surface of a photosensitive member; or other additives such as releasing agent for improving fixing ability. Owing to these additives, condensation of the toner is prevented. Further, if two-component developer is used, frictional chargeability of the toner with respect to carrier in the developing device is improved. If monocomponent developer is employed, the frictional chargeability with respect to a toner restricting member which contacts a toner carrying and feeding member of the developing device is improved.

However, after the toner was once used for developing, the additives have moved to the carrier and further from the carrier to the electrostatic latent image carrying member, and have been substantially removed from the surfaces of the toner particles.

Therefore, the collected toner contains extremely small amount of additives sticking thereto. Consequently, if the collected toner were reused without processing, there would be possibility that the essential effect of the additives could not be obtained, and specifically, deterioration of fluidity of the toner, condensation of the toner and deterioration of the frictional chargeability of the toner would be caused. As a result of the deteriorated chargeability, there may be caused dispersion of the toner and fogging, i.e., sticking of the toner to an image background on a recording material.

In spite of disadvantages described above, the resupplying of the collected toner in the prior art is performed by returning the collected toner, from which the additive has substantially disappeared, into the developing device without any processing, so that the fogging and/or the dispersion of the toner are caused.

Even when the new toner is supplied and the collected toner is supplied together with it, it is impossible to expect that the additive of the new toner sufficiently sticks to the collected toner because the new toner and the collected toner are not positively mixed prior to supplying. Further, the collected toner is supplied without processing when the new toner is not supplied. Moreover, the collected toner, which passed developing and transferring sections and a cleaning section in which it contacts, e.g., a cleaning member, has frictional charging characteristics which is extremely different from those of the new toner which has not passed the above sections, resulting in unstable quality of finished images.

Even in such a case that the collected toner is subjected to the corona charging of the same polarity as the toner polarity at a developing section, as described above, uniform charging cannot be expected, which may cause the fog and unstable quality of finished images, because the additives have hardly stuck to the collected toner.

Accordingly, it is an object of the invention to provide an improved device for supplying toner to a developing device in an electrophotographic image forming apparatus, and particularly to provide a toner supplying device in which, not only new toner but also toner collected by a cleaner can be supplied and resupplied, respectively, and further a toner fluidity and a toner chargeability can be improved in the collected toner by sticking an additive to it prior to resupplying, whereby condensation of the toner, fog in an image and dispersion of the toner can be sufficiently prevented without other countermeasures.

SUMMARY OF THE INVENTION

Based on the study for achieving the above objects, the inventors have found that sufficient mixing of collected toner and new toner prior to resupplying causes uniform tribo-electric charging of the collected toner and the new toner. Further, the inventors have found that sufficient mixing of collected toner and new toner prior to resupplying causes additives, which have fully stuck to the new toner, to stick also to the collected toner and thus improves the fluidity of the collected toner, and have devised the invention.

Accordingly, the present invention provides a toner supplying device for supplying toner to developing means which forms a toner image on an image carrying member comprising a toner agitating chamber; toner containing means for containing new toner and feeding the same to said toner agitating chamber; toner collecting means for collecting residual toner on said image carrying member and feeding the collected toner to said toner agitating chamber; toner agitating means disposed in said toner agitating chamber for mixing and agitating said new toner fed from said toner containing means and collected toner fed from said toner collecting means; and toner feeding means for feeding mixture of said toner agitated and mixed in said toner agitating camber to developing means.

According to another aspect of the invention, the toner supplying device may be provided with additive supplying means for supplying an additive to the collected toner or to mixture of the collected toner and the new toner.

According to the toner supplying device of the invention, the collected toner is resupplied to the developing device after it is temporally accommodated in the toner agitating chamber, and is positively agitated and mixed with the new toner supplied from the toner containing means. As a result, the additive which has fully stuck to the new toner or newly supplied additive sticks to the collected toner, which enables improvement of the fluidity of the collected toner.

Although the collected toner which passed the developing, transferring and cleaning processes had a chargeability which was different from that of the new toner, uniform charging can be achieved by positively mixing and agitating them prior to supplying.

After the mixing and agitation described above, the new toner and the collected toner are supplied from the toner feeding means to the developing means.

The new toner contained in the toner containing means may comprise toner particles and additive particles.

The toner feeding means may comprise feed signal generating means for generating a toner feed signal, toner transporting means for transporting the toner mixture to the developing means, and control means for activating the toner transporting means in response to the toner feed signal generated by the feed signal generating means.

The toner agitating chamber may have first, second and third openings which are adjacent to each other.

The toner containing means may contain new toner and feed the same to the toner agitating chamber through the first opening.

The toner collecting means may collect residual toner on the image carrying member and feed the collected toner to the toner agitating chamber through the second opening.

The toner feeding means may feed mixture of the toner agitated and mixed in the toner agitating chamber to developing means through the third opening.

The toner agitating means may comprise a pair of flanges, a plurality of plates disposed between the flanges, and drive means for driving and rotating flanges, so that the plates agitate and mix the collected toner and the new toner fed into the toner agitating chamber.

In this case, the toner feeding means may comprise a toner feed chamber communicated with the third opening, a feed opening provided for feeding the toner mixture to the developing means, the feed opening being parallel to the plates of the toner agitating means and having a length substantially equal to that of the plate, and toner transporting means provided in the toner feed chamber for feeding the toner mixture fed through the third opening to the developing means through the feed opening.

The toner transporting means is formed of, for example, a feed roller, which communicates with the third opening and the feed opening. The feed roller may be disposed parallel to the feed opening.

In the toner feeding means, driven mode of the toner transporting means can be selected from a transporting mode in which the toner mixture fed from the third feed opening is fed to the developing means and a non-transporting mode in which transportation of the toner mixture to the developing means is inhibited.

As described before, the control means may activate the toner transporting means in response to the toner feed signal generated by the feed signal generating means.

Further, the control means may maintain the toner transporting means in the transporting mode for a predetermined period of time after the toner feed signal is supplied, and maintain the same in the non-transporting mode after elapsing of the predetermined period.

The feed signal generating means may detect conditions of the toner in the developing means.

The feed signal generating means may detect conditions of a toner image on the image carrying member.

The additive supplying means may add an additive to the collected toner collected by the toner collecting means.

The additive contained in the additive supplying means may include fluidization agent particles.

In this case, the toner agitating means may mix and agitate the new toner fed from the toner containing means and the collected toner fed from the toner collecting means and having the additive added thereto.

These and other objects and features of the invention will become more apparent from the following description of preferred embodiments with reference to the accompanying drawings.

DETAILED DESCRIPTION OF THE PREFERRED EMBODIMENTS

Figure 1:
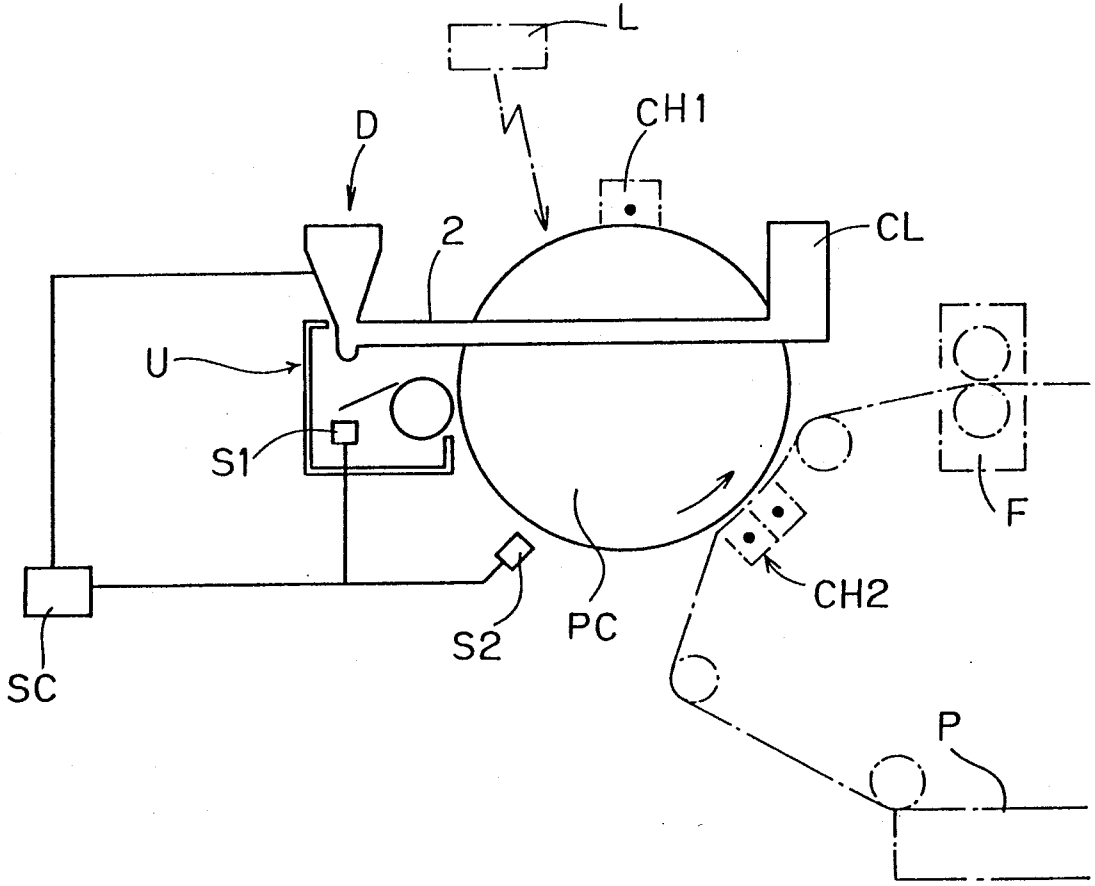
FIG. 1 is a schematic cross section illustrating an image forming apparatus which includes a toner supplying device according to the invention.

FIG. 1 illustrates an image forming apparatus using a toner supplying device according to the invention. "PC" indicates a photosensitive drum. "CL" indicates a cleaning unit Which is opposed to an outer peripheral surface of the drum (PC) and may be formed of a known unit such as a fur brush cleaning unit or blade cleaning unit. Residual toner on the photosensitive drum is scraped off by this cleaning unit and is transported through a recycle pipe 2 by a coil to a toner supplying device (D) according to the apparatus. The toner supplying device (D) will ultimately supply mixture of collected toner and refilled new toner to a developing unit (U). The illustrated developing unit (U) is a magnetic brush developing unit using two-component developer which contains mixture of toner and carrier particles. However, the device of the present invention may be applied to any known dry developing units such a cascade developing unit which cascades the two-component developer, a fur brush developing unit which supplies toner to a vibrating and rotating fur brush during development, an impression developing unit in which a pressure roller carrying the toner is pressed onto the photosensitive drum (PC) during development.

In FIG. 1, members and parts depicted by alternate long and short dash line are image forming units which are not directly concerned with the invention. "CH1" indicates a main electrical charger, "L" indicates an image exposing unit, "CH2" indicates a transfer and separation charger, "P" indicates a sheet feeding unit, and "F" indicates a fixing unit. These units are well known and thus will not be detailed hereinafter.

Figure 2:
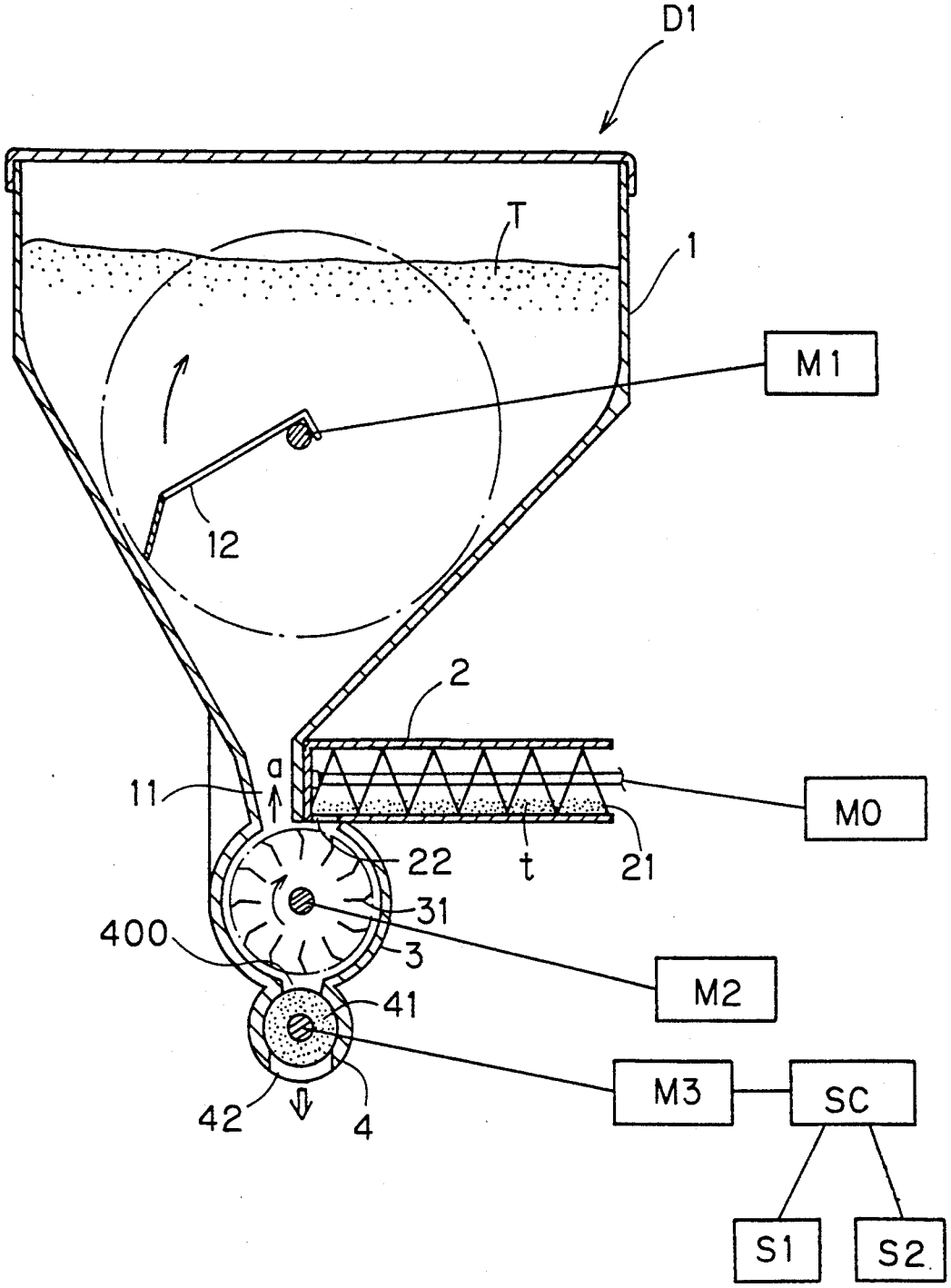
FIG. 2 is a cross section illustrating an embodiment of the invention.

FIG. 2 is a cross section of an embodiment of specific structures employed in the toner supplying device (D) shown in FIG. 1, in which the toner is supplied to the developing unit which uses the two-component developer containing the toner and carrier particles.

A toner supplying device (D1) in FIG. 2 comprises a toner hopper 1, a recycle pipe 2 for collected toner, a toner agitating chamber 3 and a toner feeder 4. The toner hopper 1 contains new toner T to which a predetermined amount of an additive, i.e., silica particles serving as a fluidization agent are added. The hopper 1 is provided at its lower end with a hopper outlet 11 through which the toner T falls, and is also provided at its interior with a rotary member 12 for agitating the toner T. The agitating member 12 is driven to rotate by driving means, i.e., an electrical motor M1.

The recycle pipe 2 extends from the vicinity of the hopper outlet 11 to the cleaner (CL) of the image forming apparatus and is connected thereto. The recycle pipe 2 is provided at a lower surface of its end with an outlet 22 for collected toner t. In the recycle pipe 2, there is provided a transporting coil 21 for transporting the toner t from the cleaner to the outlet 22. This transporting coil 21 is driven to rotate by drive means, i.e., an electrical motor M0. The outlet 22 of the recycle pipe 2 and the hopper outlet 11 are adjacent to each other.

Figure 4:
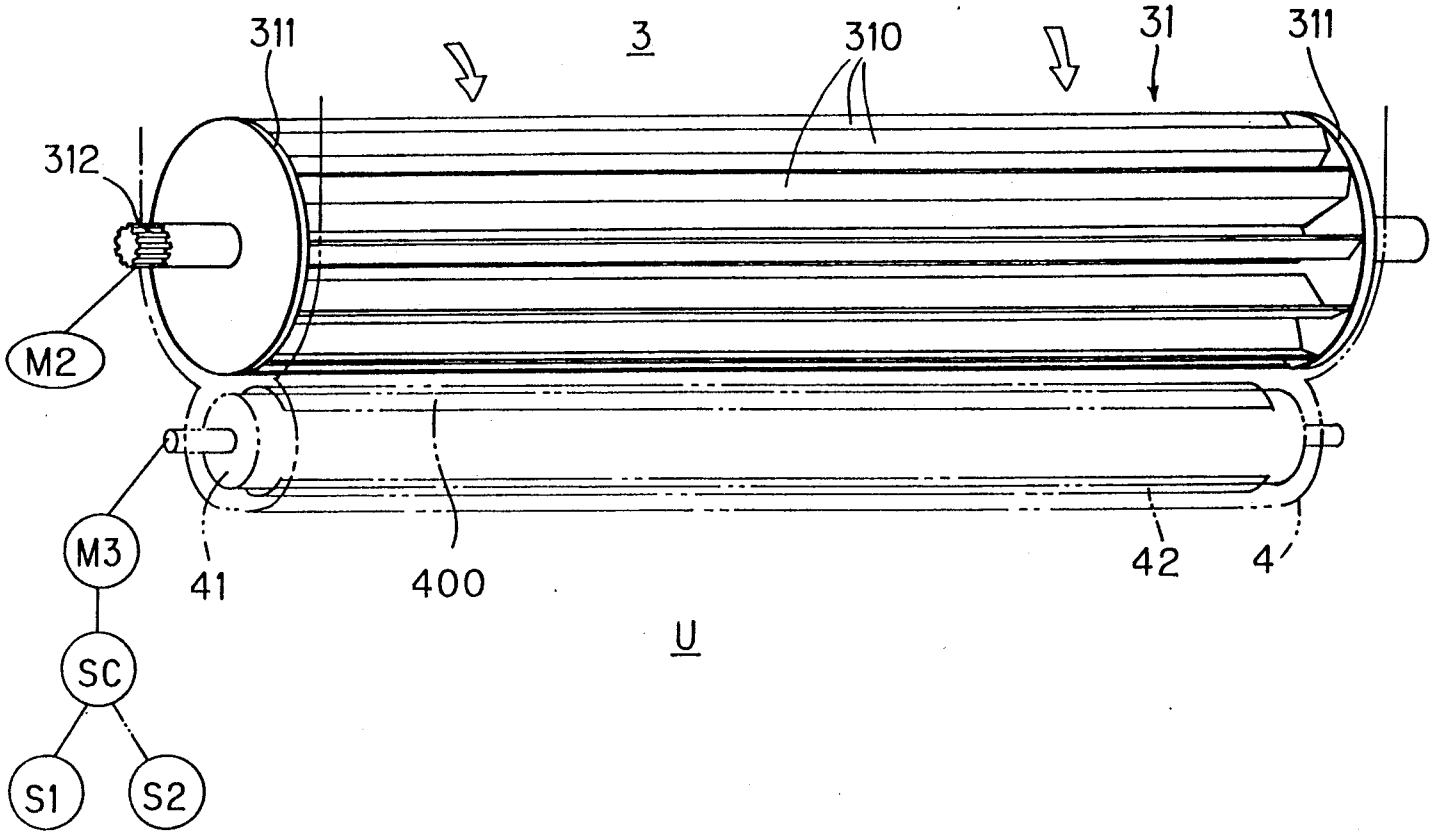
FIG. 4 is a fragmentary and schematic perspective view of an embodiment according to the invention.

An upper end of the toner agitating chamber 3 communicates with the hopper outlet 11 and the outlet 22 of the recycle pipe 2, and a lower end of the chamber 3 communicates with the toner feeder 4. In the agitating chamber 3, there is disposed a toner agitating member 31 which is driven to rotate in a clockwise direction in the Figure by drive means, i.e., an electrical motor M2. As shown in FIG. 4, the toner agitating member 31 is formed of a plurality of vanes 310 extending in a lengthwise direction of the agitating chamber 3, two flanges 311 fixing the vanes 310 and a gear 312 which mounted on a flange shaft and is driven by the motor M2. Each vane 310 has an edge portion which is bent into a L-shaped section as shown in the Figure, so that the vanes 310 rotated by the motor M2 may transport the toner in the agitating chamber 3 along an inner wall of the chamber 3 from the toner feeder 4 toward the toner hopper 1 and a sufficient stress may be applied to mixture of the new and collected toner T and t. Thus, the agitating member 31 serves to mix and agitate the toner, and also serves to push and return excessive toner T, which is falling from the hopper 1, toward the hopper 1 in a direction indicated by an arrow a in the Figure.

Owing to the stress applied by this agitating member 31, the fluidization agent is sufficiently separated from the new toner T and is applied to the collected toner t. Further, frictional charging characteristics of the collected toner t and the new toner T are uniformed.

The agitating chamber 3 and the toner feeder 4 are mutually communicated through an opening 400 which extends parallel to the vane 310 and has a length similar to a lengthwise size of the vane 310. The toner feeder 4 is provided at its interior with a toner feed roller 41 which is made from polyurethane sponge and is pressed against an inner surface of the feeder 4. This roller 41 extends parallel to the vane 310 of the toner agitating member 31 and has a length similar to that of the vane 310. A toner feed opening 42 extending parallel to the roller 41 and having a length similar to that of the roller 41 is located between the roller 41 and the developing unit U). As the roller 41 is driven to rotate by an electrical motor M3, the toner is fed or supplied to the developing unit (U) in a form of line.

The motor M3 for driving the toner feed roller 41 is activated by instructions from a control circuit (SC) connected to a sensor(s) such as a toner density sensor (S1) and an image density sensor (S2). The toner density sensor (S1) is disposed in the developing unit (U) and measures magnetic permeability for determining a toner mixing ratio of the developer formed of the toner and carrier. The image density sensor (S2) is opposed to the electrostatic latent image carrying member or photosensitive drum (PC) and measures, e.g., reflectance for determining a density of a toner image formed thereon. The control circuit (SC) receives toner feed instruction signals from the sensor(s) (S1) and/or (S2) to control the motor M3.

According to the toner supplying device (D1) described hereinabove, the member 12 rotates to agitate the new toner T in the toner hopper 1 so as to prevent the condensation, and the toner T falls through the hopper outlet 11 into the toner agitating chamber 3. On the other hand, the collected toner t is transported by the rotating coil 21 from the cleaner (CL) shown in FIG. 1 through the recycle pipe 2 to the outlet 22, and falls into the agitating chamber 3 through the outlet 22.

In the agitating chamber 3, the agitating member 31 rotates to positively mix and agitate the new toner T and the collected toner t.

Upon reception of the toner feed instruction signal, e.g., from the toner density sensor (S1) or the image density sensor (S2), the control circuit (SC) activates the motor M3 to drive and rotate the feed roller 41 for a predetermined period of time, whereby the mixture of the new toner T and the collected toner t is fed through the toner feed opening 42 to the developing unit (U).

If the toner feed instruction signal is not supplied, the control circuit (SC) does not activate the motor M3, and thus the toner is not supplied to the developing unit (U). Even in this condition, the agitating member 31 continues to mix and agitate the mixture of the new toner T and the collected toner t in the agitating chamber 3 for the subsequent toner feeding operation which will be started by the toner feed signal.

According to the toner supplying device described above, the collected toner t to which the fluidization agent has hardly stuck is not resupplied to the developing unit as it is, and the collected toner t is surely agitated and mixed with the new toner T in the toner agitating chamber 3. Therefore, the fluidization agent which has sufficiently stuck to the new toner T also sticks to the collected toner t, whereby the collected toner t is reproduced to have a good fluidity before it is supplied to the developing device. Consequently, the frictional charging of the collected toner t with the carrier can be sufficiently conducted similarly to the new toner.

Figure 3:
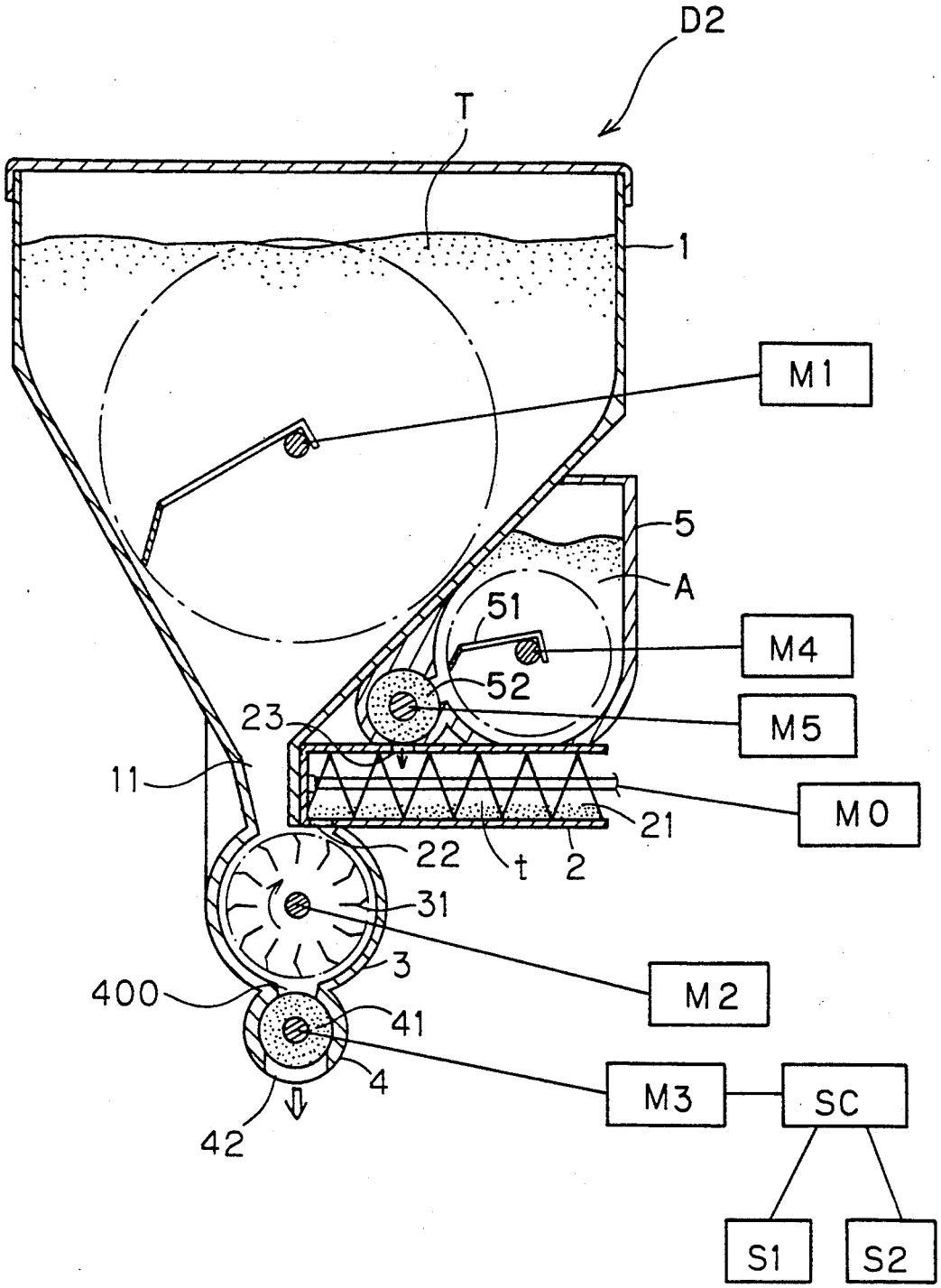
FIG. 3 is a cross section illustrating another embodiment of the invention.

Now, another embodiment will be described below with reference to a cross section in FIG. 3.

A toner supplying device (D2) in this embodiment is provided with a device 5 for supplying a fluidization agent (i.e., silica in this embodiment). Other structures are similar to those of the device shown in FIG. 2.

The silica supplying device 5 is provided at the interior thereof with a rotary member 51 for agitating the silica A, and is also provided with a feed roller 52 for feeding the silica into the recycle pipe 2. The member 51 and the feed roller 52 are driven to rotate by drive means, e.g., an electric motors M4 and M5, respectively. The feed roller 52 may be a polyurethane sponge roller, and is opposed to a silica feed opening 23 formed at the upper wall of the recycle pipe 2.

In this embodiment, the device 5 feeds the silica A to the collected toner t which is being transported through the recycle pipe to the outlet 22, and the silica A falls together with the collected toner t into the agitating chamber 3. Therefore, the new toner T, collected toner t and fed silica A are mixed and agitated in the agitating chamber 3, whereby a sufficient amount of silica sticks to the collected toner t prior to feeding thereof to the developing device. Thus, the collected toner t has a good fluidity, and then will be supplied to the developing device by the rotating feed roller 41.

The present invention is not restricted to the embodiment described above, and may be embodied in various forms.

For example, the silica feed device 5 may have a construction in which the silica A is fed to the toner agitating chamber 3.

Only the silica supplying device 5 may be employed, while eliminating the toner agitating chamber 3.

The silica supplying device 5 may contain various additives such as chargeability applying particles, cleaning assistant, photosensitive member abrasive or releasing agent.

The present invention may be applied to the developing device using monocomponent developer.

According to the invention, the device for supplying the toner to the developing device in the electrophotographic image forming apparatus can perform resupplying of the toner collected by the cleaner, in addition to supplying of the new toner, after sticking an additive such as the fluidization agent to the collected toner. Therefore, the invention can provide the toner supplying device which improves the toner fluidity and chargeability of the collected toner, and thus it is possible to prevent or suppress disadvantages such as condensation of the toner, for in the image and dispersion of the toner Although particular preferred embodiments of the invention have been disclosed in detail for illustrative purpose, it will be recognized that other variations or modifications may be made without departing from the spirit and scope of the invention as claimed.

What is claimed is:

1. In an image forming apparatus, a toner supplying device for supplying toner to developing means which forms a toner image on an image carrying member during operation of said image forming apparatus comprising::

a toner agitating chamber;

toner collecting means for collecting residual toner on said image carrying member and for feeding the collected toner to said toner agitating chamber during said operation of said image forming apparatus;

toner containing means for containing new toner and for also feeding the new toner to said toner agitating chamber during said operation of said image forming apparatus;

toner agitating means disposed in said toner agitating chamber for agitating said new toner fed from said toner containing means and collected toner fed from said toner collecting means; and toner feeding means, separately provided from said toner agitating means, for feeding mixture of said toner agitated and mixed in said toner agitating chamber to the developing means.

2. A toner supplying device as claimed in claim 1 wherein said new toner contained in said toner containing means comprises toner particles and additive particles.

3. A toner supplying device as claimed in claim 1 wherein said toner feeding means comprises:

feed signal generating means for generating a toner feed signal;

toner transporting means for transporting said toner mixture to said developing means; and control means for activating said toner transporting means in response to said toner feed signal generated by said feed signal generating means.

4. In an image forming apparatus, a toner supplying device for supplying toner to developing means which forms a toner image on an image carrying member during operation of said image forming apparatus comprising:

a toner agitating chamber having first, second and third openings which are adjacent to each other;

toner collecting means for collecting residual toner on said image carrying member and for feeding the collected toner to said toner agitating chamber through said second opening during said operation of said image forming apparatus;

toner containing means for containing new toner and for also feeding the new toner to said toner agitating chamber through said first opening during said operation of said image forming apparatus;

toner agitating means disposed in said toner agitating chamber for agitating said new toner fed from said toner containing means and said collected toner fed from said toner collecting means; and toner feeding means, separately provided from said toner agitating means, for feeding a mixture of said toner agitated and mixed in said toner agitating chamber to developing means through said third opening.

5. A toner supplying device as claimed in claim 4 wherein said new toner container in said toner containing means comprises toner particles and additive particles.

6. A toner supplying device as claimed in claim 4 wherein said toner agitating means comprises:

a pair of spaced flanges;

a plurality of plates extending parallel to one another between said flanges; and drive means for driving and rotating said flanges so that said plurality of plates agitate the collected toner and the new toner fed into said toner agitating chamber.

7. A toner supplying device as claimed in claim 6 wherein said toner feeding means comprises:

a toner feed chamber communicated with said third opening;

a feed opening provided for feeding said toner mixture to said developing means, said feed opening being parallel to said plurality of plates of said toner agitating means and having a length substantially equal to that of each of said plates; and toner transporting means provided in said toner feed chamber for feeding said toner mixture fed through said third opening to said developing means through the feed opening.

8. A toner supplying device as claimed in claim 4 wherein said toner feeding means comprises:

feed signal generating means for generating a toner feed signal;

toner transporting means of which driven mode can be selected from a transporting mode in which said toner mixture fed from said third feed opening is fed to said developing means and a non-transporting mode in which transportation of said toner mixture to said developing means is inhibited; and control means for activating said toner transporting means in response to said toner feed signal generated by said feed signal generating means.

9. A toner supplying device as claimed in claim 8 wherein said feed signal generating means detects conditions of said toner in said developing means.

10. A toner supplying device as claimed in claim 8 wherein said feed signal generating means detects conditions of a toner image on said image carrying member.

11. A toner supplying device as claimed in claim 8 wherein said control means maintains said toner transporting means in said transporting mode for a predetermined period of time after said toner feed signal is supplied, and maintains the same in said non-transporting mode after elapsing of said predetermined period.

12. A toner supplying device as claimed in claim 4 wherein said toner feeding means comprises:

a toner feed chamber communicated with said third opening of said toner agitating chamber and having a feed opening communicated with said developing means;

a feed roller disposed in said toner feed chamber and being adjacent to said third opening and said feed opening; and drive means for driving said feed roller to rotate, so that said toner mixture fed through said third opening is transported to said feed opening.

13. A toner supplying device as claimed in claim 12 wherein said feed opening is parallel to said feed roller.

14. In an image forming apparatus, a toner supplying device for supplying toner to developing means which forms a toner image on an image carrying member during an image forming operation comprising:

a toner feed chamber;

toner collecting means for collecting residual toner on said image carrying member and for feeding the collected toner to said toner feed chamber during said operation of said image forming apparatus;

toner containing means for containing new toner for also feeding the new toner to said toner feed chamber during said operation of said image forming apparatus;

additive supplying means for adding an additive to the toner feed chamber; and toner feeding means for feeding mixture of said new toner, which is fed from said toner containing means, said collected toner, which has been fed by the toner collecting means and said additive supplied by said additive supplying means to the developing means from said toner feed chamber.

15. A toner supplying device as claimed in claim 14 wherein said additive contained in said additive supplying means includes fluidization agent particles.

16. A toner supplying device as claimed in claim 14 wherein said toner feeding means comprises:

toner agitating means disposed in said toner feed chamber for agitating said new toner fed from said toner containing means and said collected toner fed from said toner collecting means and having said additive added thereto; and toner transporting means for transporting mixture of said toner mixed and agitated by said toner agitating means to said developing means.

17. A toner supplying device as claimed in claim 14 wherein said toner feeding means comprises:

feed signal generating means for generating a toner feed signal;

toner transporting means for transporting said toner mixture to said developing means; and control means for activating said toner transporting means in response to said toner feed signal generated by said feed signal generating means.

18. In an image forming apparatus, a toner supplying device for supplying toner to developing means which forms a toner image on an image carrying member during operation of said image forming apparatus comprising:

a toner agitating chamber having first, second and third openings which are adjacent to each other;

toner collecting means for collecting residual toner on said image carrying member;

toner transporting means for transporting said collected toner from said toner collecting means to said toner agitating chamber during said operation of said image forming apparatus;

toner containing means for containing new toner for also feeding the new toner to said toner agitating chamber during said operation of said image forming apparatus;

additive supplying means for adding an additive to the toner agitating chamber;

toner agitating means disposed in said toner agitating chamber for mixing and agitating said new toner fed from said toner containing means and said collected toner fed from said toner collecting means and said additive supplied by said additive supplying means; and toner feeding means for feeding mixture of said toner agitated and mixed in said toner agitating chamber to developing means.

19. A toner supplying device as claimed in claim 18 wherein said additive contained in said additive supplying means includes fluidization agent particles.

20. A toner supplying device as claimed in claim 18 wherein said toner agitating means comprises:

a pair of spaced flanges;

a plurality of plates extending parallel to one another between said flanges; and drive means for driving and rotating said flanges, so that said plurality of plates agitate and mix the collected toner and the new toner fed into said toner agitating chamber.

21. A toner supplying device as claimed in claim 20 wherein said toner feeding means comprises:

feed signal generating means for generating a toner feed signal;

toner transporting means of which driven mode can be selected from a transporting mode in which said toner mixture fed from said third feed opening is fed to said developing means and a non-transporting mode in which transportation of said toner mixture to said developing means is inhibited; and control means for activating said toner transporting means in response to said toner feed signal generated by said feed signal generating means.

22. A toner supplying device as claimed in claim 21 wherein said feed signal generating means detects conditions of said toner in said developing means.

23. A toner supplying device as claimed in claim 21 wherein said feed signal generating means detects conditions of a toner image on said image carrying member.

24. A toner supplying device as claimed in claim 21 wherein said control means maintains said toner transporting means in said transporting mode for a predetermined period of time after said toner feed signal is supplied, and maintains the same in said non-transporting mode after elapsing of said predetermined period.

25. A toner supplying device as claimed in claim 20 wherein said toner feeding means comprises:

a toner feed chamber communicated with said third opening of said toner agitating chamber and having a feed opening communicated with said developing means;

a feed roller disposed in said toner feed chamber and being adjacent to said third opening and said feed opening; and drive means for driving said feed roller to rotate, so that said toner mixture fed through said third opening is transported to said feed opening.

26. A toner supplying device as claimed in claim 25 wherein said feed opening is parallel to said feed roller.

27. A toner supplying device as claimed in claim 20 wherein said toner feeding means comprises:

a toner feed chamber communicated with said third opening;

a feed opening provided for feeding said toner mixture to said developing means, said feed opening being parallel to said plurality of plates of said toner agitating means and having a length substantially equal to that of each of said plates; and toner transporting means provided in said toner feed chamber for feeding said toner mixture fed through said third opening to said developing means.

28. In an image forming apparatus, a toner supplying device for supplying toner to developing means which forms a toner image on an image carrying member during operation of said image forming apparatus comprising:

a toner agitating chamber having an inlet port and an outlet port;

toner collecting means for collecting residual toner on said image carrying member and for feeding the collected toner to said toner agitating chamber during said operation of said image forming apparatus;

a toner containing hopper for containing new toner and for also feeding the new toner to said toner agitating chamber during said operation of said image forming apparatus, said hopper communicating with said toner agitating chamber through the inlet port;

toner agitating means disposed in said toner agitating chamber for agitating said new toner fed from said toner containing means and collected toner fed from said toner collecting means; and toner feeding means for feeding mixture of said toner agitated and mixed in said toner agitating chamber to the developing means, said feeding means communicating with the agitating chamber through the outlet port.

* * * * *

UNITED STATES PATENT AND TRADEMARK OFFICE

CERTIFICATE OF CORRECTION

PATENT NO. : 5,307,128

DATED : April 26, 1994

INVENTOR(S) : Hiroshi Murasaki, et al.

It is certified that error appears in the above-identified patent and that said Letters Patent is hereby corrected as shown below:

In col. 4, line 51, change "Which" to --which--.

In col. 8, line 53 (claim 5, line 2), change "container" to --contained--.

In col. 10, line 38 (claim 18, line 14), after "new toner" insert --and--.

In col. 12, line 31 (claim 28, line 21), change "means" to --hopper--.

Signed and Sealed this

Ninth Day of August, 1994

Bruce Lehman

*Attest:*

BRUCE LEHMAN

*Attesting Officer*

*Commissioner of Patents and Trademarks*